US006883529B2

(12) United States Patent
Kvaternik

(10) Patent No.: US 6,883,529 B2
(45) Date of Patent: Apr. 26, 2005

(54) REMOVABLE TRAY FOR A WALKER, AND METHOD FOR PROVIDING THE SAME

(76) Inventor: Naomi Kvaternik, 7018 W. 69th St., Overland Park, KS (US) 66204

( * ) Notice: Subject to any disclaimer, the term of this patent is extended or adjusted under 35 U.S.C. 154(b) by 0 days.

(21) Appl. No.: 10/670,931

(22) Filed: Sep. 25, 2003

(65) Prior Publication Data

US 2005/0067004 A1 Mar. 31, 2005

(51) Int. Cl.[7] ..... A61H 3/00
(52) U.S. Cl. ..... 135/66; 135/67
(58) Field of Search ..... 135/66, 67, 65; 297/5, 6; 108/157.1, 157.11, 157.13, 159.11, 108/42

(56) References Cited

U.S. PATENT DOCUMENTS

| | | | | | |
|---|---|---|---|---|---|
| 3,232,251 | A | | 2/1966 | Hughes | |
| D207,851 | S | * | 6/1967 | Separa | D6/449 |
| 3,516,425 | A | * | 6/1970 | Rigal | 135/67 |
| 3,957,071 | A | * | 5/1976 | Kenner | 135/66 |
| 4,251,044 | A | * | 2/1981 | Olson | 248/166 |
| 4,452,484 | A | * | 6/1984 | Pastor | 297/6 |
| 4,708,274 | A | * | 11/1987 | Roche | 224/407 |
| 4,907,839 | A | * | 3/1990 | Rose et al. | 297/6 |
| 5,133,377 | A | * | 7/1992 | Truxillo | 135/67 |
| 5,217,032 | A | | 6/1993 | Jobst | |
| 5,273,063 | A | * | 12/1993 | Farr et al. | 135/66 |
| 5,642,748 | A | | 7/1997 | Obitts | |
| 5,694,959 | A | | 12/1997 | Hiller et al. | |
| 5,882,067 | A | * | 3/1999 | Carbajal et al. | 297/6 |
| 6,302,126 | B1 | | 10/2001 | Nava | |

FOREIGN PATENT DOCUMENTS

| | | | |
|---|---|---|---|
| GB | 2261173 | * | 5/1993 |

* cited by examiner

*Primary Examiner*—Janet M. Wilkens
(74) *Attorney, Agent, or Firm*—David E Herron, II

(57) ABSTRACT

A walker and tray combination, together with a method of providing the same, is shown and described. The combination includes a first pair of spaced-apart legs connected to one another by a first upper connecting bar extending between respective points adjacent an upper end of each of the first pair of legs. The combination also includes a second pair of spaced-apart legs connected to one another by a second upper connecting bar extending between respective points adjacent an upper end of each of the second pair of legs. At least one strut connects the first pair of legs to the second pair of legs, and a connector is configured to selectively retain the tray in one of a primary position or a secondary position. The method includes the steps of configuring the tray to be selectively connectable to the walker in one of a primary position or a secondary position.

18 Claims, 3 Drawing Sheets

FIG. 3
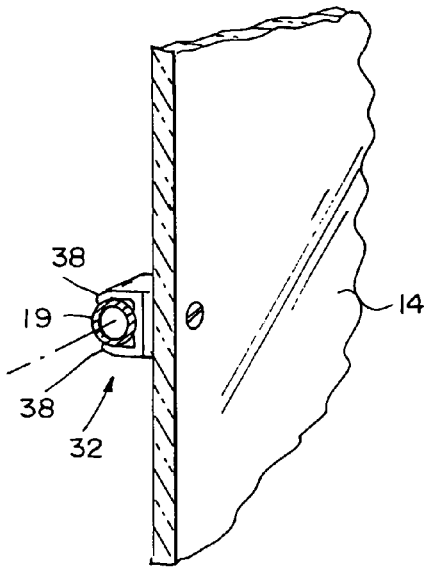
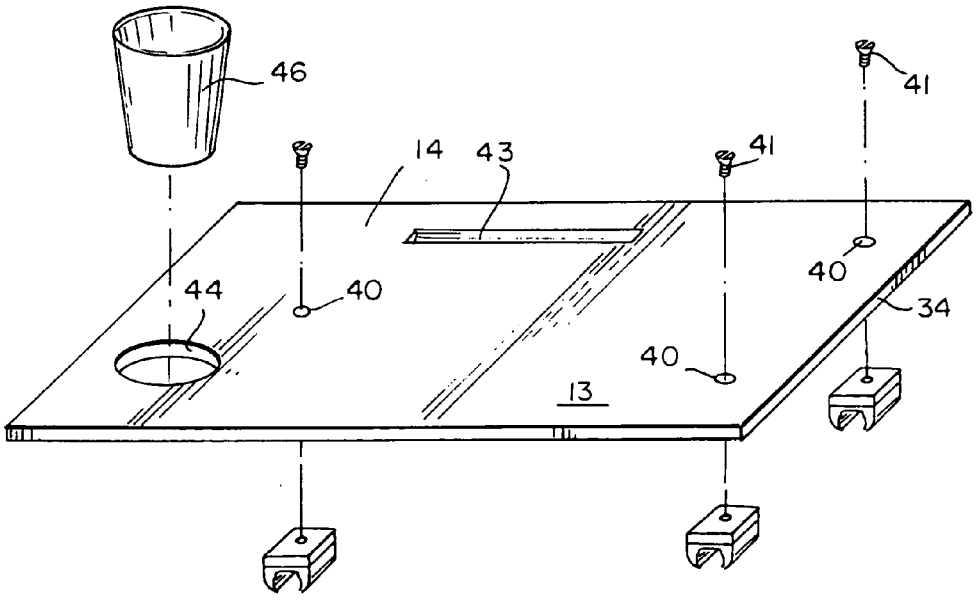
FIG. 4

REMOVABLE TRAY FOR A WALKER, AND METHOD FOR PROVIDING THE SAME

SUMMARY OF THE INVENTION

The invention is a walker and tray combination, and a method for providing the same.

The Inventive Combination

The inventive combination includes a first pair of spaced-apart legs connected to one another by a first upper connecting bar that extends between upper ends of each of the first pair of legs. The combination further includes a second pair of spaced-apart legs similarly connected to one another. At least one strut connects the first pair of legs to the second pair of legs.

The inventive combination further includes a connector configured to selectively retain the tray in either a primary position, wherein the first and second connecting bars support the tray, or a secondary position, wherein the tray is in a plane generally parallel to the first pair of legs.

In a preferred embodiment, the connector is on a lower surface of the tray and grips the first upper connecting bar when the tray is in either the primary position or the secondary position. Optionally, the inventive combination may include a first lower connecting bar that connects the first pair of legs to one another, and a second connector on the lower surface of the tray that grips the first lower connecting bar when the tray is in the secondary position.

The invention may also include a connector on the lower surface of the tray that is positioned to grip the second upper connecting bar when the tray is in the primary position. The connectors, as referred to herein, may comprise at least one biasable claw configured to releasably grip the respective portions of the walker. In a preferred embodiment, the tray is polymethyl methacralate.

A first handlebar may extend upwardly from an upper end of at least one of the first pair of spaced-apart legs; likewise, a second handlebar may extend upwardly from an upper end of at least one of the second pair of spaced apart legs. In this embodiment, the first and second handlebars may cooperate to limit movement of the tray in a direction generally parallel to the first and second upper connecting bars when the tray is in the primary position. Optionally, the tray may cantileverly extend outwardly from the walker when the tray is in the primary position.

The Inventive Method

The inventive method includes the steps of providing a first pair of spaced-apart legs, and connecting the first pair of spaced apart legs to one another by a first upper connecting bar that connects an upper end of each of the first pair of legs. Similarly, the inventive method also includes providing a second pair of spaced-apart legs, and similarly connecting the second pair of with an analogous second upper connecting bar.

The method also includes connecting the first pair of legs to the second pair of legs with at least one strut, and configuring the tray to be selectively connectable to the walker in one of a primary position (wherein the first and second upper connecting bars support the tray) or a secondary position (wherein the tray is secured to the walker in a generally parallel relation with each of the first pair of legs).

Optionally, the inventive method may include the steps of providing a lower connecting bar connecting the first pair of legs and positioning a first connector on a lower surface of the tray in such a way that the first connector to grips the first upper connecting bar when the tray is in any one of the primary position or the secondary position. Also, this embodiment of the method may include the steps of positioning a second connector on a lower surface of the tray, and configuring the second connector so that it grips first lower connecting bar when the tray is in the secondary position.

In another preferred embodiment of the method, the invention may include the steps of securing a first connector to a lower surface of the tray in a location adjacent to a lateral edge of the tray, and configuring the first connector to grip the first connecting bar. Similarly, this embodiment will include the further steps of securing a second connector to a lower surface of the tray and positioning the second connector to grip the second connecting bar when the tray is in the primary position. Furthermore, one may select biasable claws to serve as connectors.

In a preferred embodiment of the method the invention includes the steps of positioning a first and second handlebars to extend upwardly from respective upper ends of at least one of each of the first pair or second pairs of spaced-apart legs. The handlebars should be positioned so as to limit movement in a direction parallel to the first and second upper connecting bars when the tray is in the primary position.

Of course, the tray—which may be composed of polymethyl methacralate—may be removable entirely from the walker.

Other objects, advantages and novel features of the present invention will become apparent from the following detailed description of the invention when considered in conjunction with the accompanying drawings.

BRIEF DESCRIPTION OF THE DRAWINGS

FIG. 3 is a cross-sectional view of the tray as positioned in FIG. 2, showing in detail the connector and the lower connecting bar of the walker.

FIG. 4 is an isolated exploded perspective view detailing the tray and the connectors.

DETAILED DESCRIPTION OF THE PREFERRED EMBODIMENTS

Figure 1:
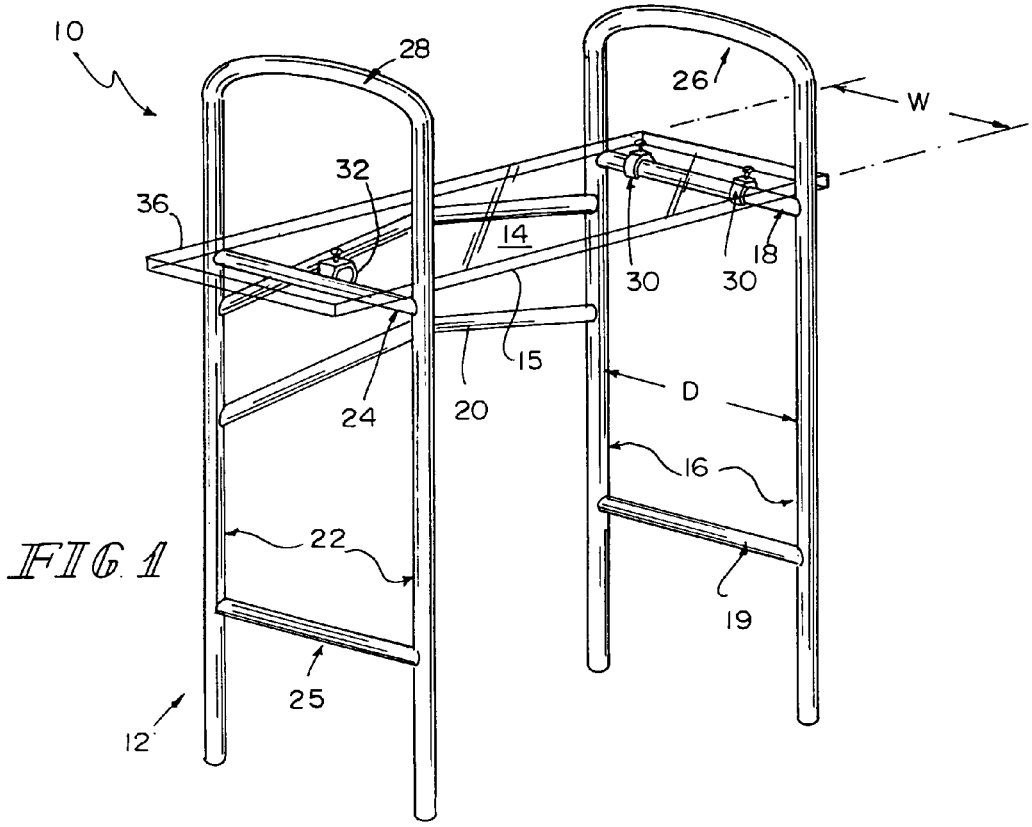
FIG. 1 is a perspective view of the walker and tray combination, showing the tray in its primary position.

FIG. 1 shows a perspective view of the inventive combination 10 of a walker 12 and a tray 14. The walker 12 includes a first pair of legs 16 having a first upper connecting bar 18 and a first lower connecting bar 19. First handlebars 26 are positioned adjacent an upper end of each of the first pair of legs 16.

Still referring to FIG. 1, the walker 12 further includes at least one strut 20 connecting the first pair of legs 16 to the second pair of legs 22. In preferred embodiments, the second pair of legs 22 is substantially analogous and symmetric with respect to the first pair of legs 16. As such, a second upper connecting bar 24 connects the legs of the second pair 22 at a point adjacent an upper end of the legs 22, and a second lower connecting bar 25 extends between the legs of the second pair of legs 22 at a point intermediate the upper and lower ends of each of the second pair of legs.

FIG. 1 also shows the tray 14 in its primary position. A plurality of connectors 30, 32 are secured to the lower surface 15 of the tray 14. The first connector 30 is shown to include a pair of biasable claws secured to the lower surface 15; however, other types of connectors are certainly within the scope of the invention. For example, magnetic connectors may be positioned to releasably grip the first upper connecting bar 18, or a male-female type of connecting means may also be used wherein the upper connecting bar bears one of a male or a female connector configured to mate with a female or male connector positioned on the tray. In any regard, it is preferred that the connection, whatever type is selected, holds the tray steady, but is removable with little effort.

Still referring to FIG. 1, it should be noted that the connector 30 may include only a single biasable claw. As the tray 14 is lowered onto the respective upper connecting bars 18, 19, the connectors 30 outwardly deform to receive the first upper connecting bar 30, thereby creating a snap-like fit wherein the tray is retained in the first position. In one embodiment of this invention, the lower surface of the tray rests directly on the second upper connecting bar 24. However, another connector (not shown) may also be positioned on the lower surface and configured to releasably grip the second upper connecting bar 24 to retain the tray 14 in the primary position.

As shown in FIG. 1, the tray 14 should be dimensioned so that its width W is only slightly less than the distance D that separates each leg of the first and second pairs of legs, 16, 22. Thus, when the tray 14 is connected to the walker 12 in its primary position, the legs 16, 22 and handlebars 26, 28 cooperate to limit movement of the tray 14 in a direction generally parallel to the first and second upper connecting bars 18, 24.

Still referring to FIG. 1, the tray 14 may extend cantileverly past a plane containing the second pair of legs 22 to form a ledge 36.

As seen in FIG. 1, the connector 32 on the lower surface 15 is nonfunctional when the tray 14 is in the primary position. Rather, in this shown embodiment of the combination 10 that is shown in FIG. 1, the lower surface 15 of the tray rests directly upon the second upper 24. Of course, an additional connector (not shown) may be secured to the lower surface 15 and positioned to grip the second upper connecting bar 24 when the tray 14 is in its primary position, as shown. For the sake of easing and expediting assembly, and reducing the number of required component parts, however, an additional connector is not preferred. The placement of the second connector 32, and the option of a third connector are discussed in greater detail with regard to FIG. 2.

Figure 2:
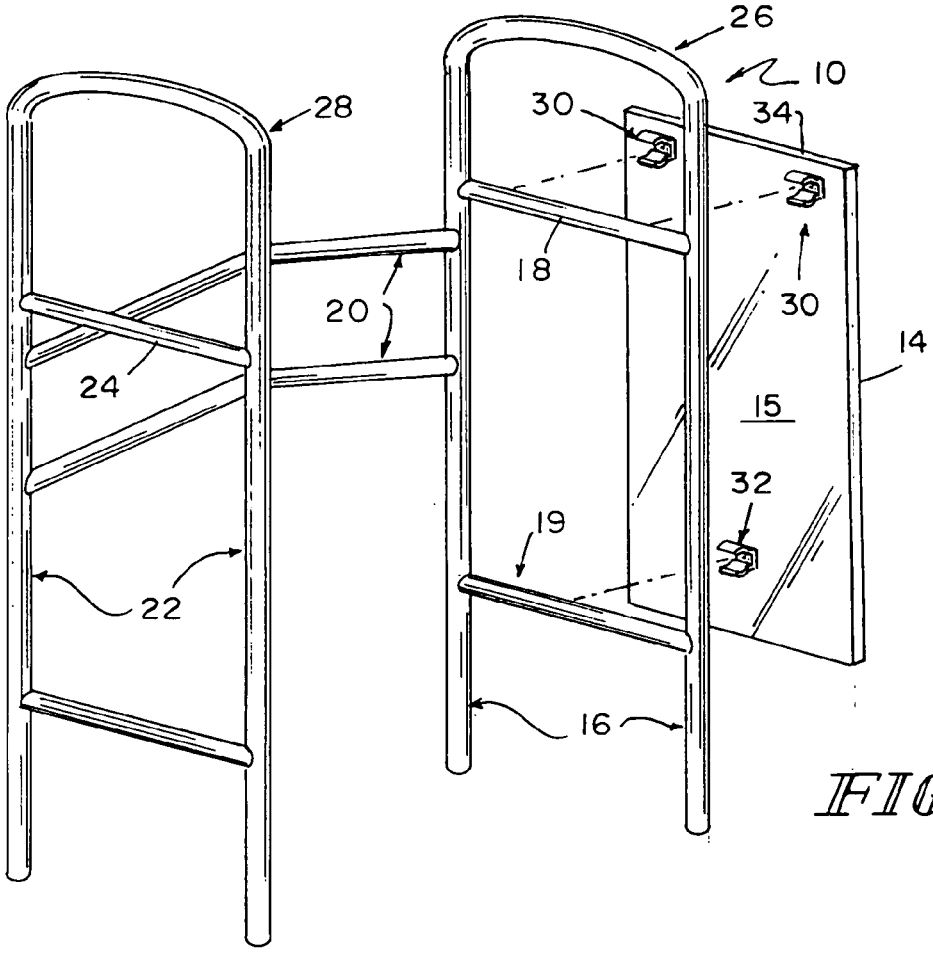
FIG. 2 is a perspective view of the walker and tray combination, showing the tray in its secondary position.

FIG. 2 shows the inventive combination 10 of a walker 12 and a tray 14, showing instead the tray 14 in a secondary position. The parts of the walker 12 and tray 14 are identical to the parts discussed with regard to FIG. 1.

As shown in FIG. 2, the tray 14 when in the secondary position is attached to the walker 12 in a generally parallel relation to a plane containing the first pair of legs 16 and the first upper 18 and first lower 19 connecting bars. A pair of connectors 30, 32 are secured to a lower surface 15 of the tray 14, and are positioned to releasably grip the first upper connecting bar 18 and first lower connecting bar 19, respectively.

As shown in FIG. 2, the connector 30 includes a pair of biasable claws arranged in a generally collinear fashion on the lower surface 15 of the tray 14, and positioned substantially adjacent a lateral edge 34 of the tray 14. Of course, a single claw could be used, and is certainly within the scope of the invention.

As shown in FIG. 2, a second connector 32 is positioned to grip the lower connecting bar 19 when the tray 14 is in its secondary position. In a preferred embodiment of the combination 10, the first lower connecting bar 19 and the second upper connecting bar 24 are equidistant from the first upper connecting bar 18. Thus, in this embodiment, a single connector 32 may grip either the first lower connecting bar 19 (when the tray is in the secondary position as shown in FIG. 2), or the second upper connecting bar 24 (when the tray is in the primary position, as shown in FIG. 1). Of course, a third or fourth connector (not shown) may be positioned on a lower surface of the tray in the event the first lower connecting bar 19 and the second upper connecting bar 24 are NOT in fact equidistant from the first upper connecting bar 18.

FIG. 3 shows a close-up, cross-sectional view detailing the cooperative connection between the tray 14, the second connector 32, and the first lower connecting bar 19. The second connector 32 is a claw having biasable fingers 38 that deform outwardly to allow the second lower connecting bar 19 to enter the connector 32. Once in the position as shown in FIG. 3, the fingers 38 are biased back into a position that grips the second lower connecting bar 19 and holds the tray 14 in place. Of course, the first connector(s) 30 are shown to be analogous in structure, but they need not be. Rather, any known type of connection, such as a male-female connection, a snap-fit connection, or a magnetic-type of coupling would be within the scope of the invention.

FIG. 4 shows an isolated perspective view of the tray 14. The tray 14 bears holes 40; a screw 41 passes through each respective hole 40 and secures a respective connector 30, 32 to the lower surface 15 of the tray 14. Preferably, the screws 41 each bear a flat-head that can become flush with the upper surface 13 of the tray 14. When in its primary position, the tray 14 may be used as a desk; thus, an indent 43 may be formed on an upper surface 13 of the tray 14 and may serve as a pencil holder. Also, a large aperture 44 may be formed to serve as a holder for a cup 46.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A walker and a tray in combination, comprising:

a first pair of spaced-apart legs connected to one another by a first upper connecting bar extending between respective points adjacent an upper end of each of the first pair of legs;

a second pair of spaced-apart legs connected to one another by a second upper connecting bar extending between respective points adjacent an upper end of each of the second pair of legs;

at least one strut connecting the first pair of legs to the second pair of legs;

a connector configured to selectively retain the tray in one of a primary position, such that first and second upper connecting bars support the tray; and, a secondary position, such that the tray is in a plane generally parallel to the first pair of legs; wherein, a first edge of the tray cantileverly extends outwardly from the walker and forms a first ledge extending from the walker when the tray is in the primary position, and a second edge of the tray cantileverly extends outwardly from the walker and forms a second ledge extending from the walker when the tray is in the primary position, and wherein, the first edge extends outwardly from the walker by a distance greater than the second edge when the tray is in the primary position.

2. The walker and tray combination as in claim 1, the connector being positioned on a lower surface of the tray and configured to grip the first upper connecting bar when the tray is in one of the primary position or the secondary position.

3. The walker and tray combination as in claim 2, further comprising:

a first lower connecting bar extending between the first pair of legs; and, a second connector on the lower surface of the tray and positioned to grip the first lower connecting bar when the tray is in the secondary position.

4. The walker and tray combination as in claim 2, further comprising:

a second connector on the lower surface of the tray and positioned to grip the second upper connecting bar when the tray is in the primary position.

5. The walker and tray combination as in claim 1, wherein the connector comprises at least one biasable claw configured to releasably grip the walker.

6. The walker and tray combination as in claim 1, wherein the tray is polymethyl methacralate.

7. The walker and tray combination as in claim 1, further comprising:

a first handlebar extending upwardly from an upper end of at least one of the first pair of spaced-apart legs; and, a second handlebar extending upwardly from an upper end of at least one of the second pair of spaced apart legs.

8. The walker and tray combination as in claim 7, wherein the first and second handlebars cooperate to limit movement of the tray in a direction generally parallel to the first and second upper connecting bars when the tray is in the primary position.

9. A method of providing a removable tray to a walker, the method comprising the steps of:

providing a first pair of spaced-apart legs;

connecting the first pair of spaced apart legs to one another by a first upper connecting bar extending between respective points adjacent an upper end of each of the first pair of legs;

providing a second pair of spaced-apart legs;

connecting the second pair of legs to one another by a second upper connecting bar extending between respective points adjacent an upper end of each of the second pair of legs;

connecting the first pair of legs to the second pair of legs by at least one strut;

configuring a tray to be selectively connectable to the walker in one of a primary position, wherein the first and second upper connecting bars support the tray; or, a secondary position, wherein the tray is secured to the walker in a generally parallel relation with each of the first pair of legs; and, configuring the tray so that a first edge extends cantileverly past a plane containing each of the first pair of legs when the tray is in the primary position, thereby forming a first ledge extending outwardly from the walker;

configuring the tray so that a second edge extends past a plane containing each of the second pair of legs when the tray is in the primary position, thereby forming a second ledge extending outwardly from the walker; and, creating the first ledge to cantileverly extend outwardly from the walker a distance greater than the second ledge when the tray is in the primary position.

10. The method as in claim 9, further comprising the step of providing a lower connecting bar connecting the first pair of legs; and positioning a first connector on a lower surface of the tray;

configuring the first connector to grip the first upper connecting bar when the tray is in any one of the primary position or the secondary position; and, positioning a second connector on a lower surface of the tray; and configuring the second connector to grip the lower connecting bar when the tray is in the secondary position.

11. The method as in claim 9, further including the steps of securing a first connector to a lower surface of the tray in a location adjacent to a lateral edge of the tray; and, configuring the first connector to grip the first upper connecting bar;

securing a second connector to a lower surface of the tray;

positioning the second connector to grip the second upper connecting bar when the tray is in the primary position.

12. The method as in claim 9, further comprising the step of selecting biasable claws to serve as connectors that are configured to grip respective portions of the walker.

13. The method as in claim 9, further comprising the steps of positioning a first handlebar to extend upwardly from an upper end of at least one of the first pair of spaced-apart legs;

positioning a second handlebar to extend upwardly from an upper end of at least one of the second pair of spaced apart legs; and, cooperatively configuring the respective handlebars and the tray so the handlebars limit movement in a direction parallel to the first and second upper connecting bars when the tray is in the primary position.

14. The method as in claim 9, further comprising the step of removing the tray from the walker.

15. The method as in claim 9, further comprising the step of making the tray out of polymethyl methacralate.

16. A walker and tray combination, comprising:

a tray;

a first pair of spaced-apart legs connected to one another by a first upper connecting bar extending between respective points adjacent an upper end of each of the first pair of legs; and a first lower connecting bar extending between respective points intermediate opposing ends of each leg of the first pair of legs; and, a second pair of spaced-apart legs connected to one another by a second upper connecting bar extending between respective points adjacent an upper end of each of the second pair of legs;

at least one strut connecting the first pair of legs to the second pair of legs;

a first connector on a lower surface of the tray and configured to grip the first upper connecting bar when the tray is in a primary position such that the first and second connecting bars support the tray; and grip the first upper connecting bar when the tray is in a secondary position such that the connector retains the tray in a plane generally parallel to each of the first pair of legs; and, a second connector on a lower surface of the tray and configured to grip the first lower connecting bar when the tray is in the secondary position;

a first handlebar extending upwardly from an upper end of at least one of the first pair of spaced-apart legs; and, a second handlebar extending upwardly from an upper end of at least one of the second pair of spaced apart legs; wherein, the tray is positioned on the first and second connecting bars and beneath the first and second handlebars and a first edge of the tray cantileverly extends to from a first ledge extending outwardly from a plane containing the first pair of legs, and a second edge of the tray cantileverly extends to form a second ledge extending outwardly from a plane containing the second pair of legs when in the primary position; and wherein, the first ledge extends cantileverly outward from the walker by a distance greater than the second ledge; and, the first and second handlebars cooperate to limit movement of the tray in a direction generally parallel to the fit and second upper connecting bars.

17. The walker and tray combination as in claim 16, further comprising:

a third connector positioned on a lower surface of the tray and configured to grip the second upper connecting bar when the tray is in the primary position.

18. The walker and tray combination as in claim 17, wherein, the first lower connecting bar and the second upper connecting bar are equidistant from the first upper connecting bar; and wherein, the second connector is configured to grip the second upper connecting bar when the tray is in the primary position.

* * * * *